US008827793B2

(12) United States Patent
Kido

(10) Patent No.: US 8,827,793 B2
(45) Date of Patent: Sep. 9, 2014

(54) GAMING MACHINE

(75) Inventor: Katsuhiro Kido, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 787 days.

(21) Appl. No.: 12/264,652

(22) Filed: Nov. 4, 2008

(65) Prior Publication Data

US 2009/0227319 A1 Sep. 10, 2009

Related U.S. Application Data

(60) Provisional application No. 61/035,150, filed on Mar. 10, 2008.

(51) Int. Cl.
*A63F 5/00* (2006.01)
*G07F 17/32* (2006.01)

(52) U.S. Cl.
CPC ..... *G07F 17/3211* (2013.01); *G07F 17/3258* (2013.01)
USPC ..... 463/17

(58) Field of Classification Search
USPC ..... 463/17, 20, 25, 26, 42
See application file for complete search history.

(56) References Cited

U.S. PATENT DOCUMENTS

2004/0023712 A1 2/2004 Oliver
2005/0059472 A1 3/2005 Joshi et al.
2005/0239536 A1 10/2005 Ogiwara
2006/0094493 A1* 5/2006 Kido ..... 463/17
2007/0010312 A1* 1/2007 Ike et al. ..... 463/17
2007/0054729 A1* 3/2007 Hornik et al. ..... 463/16
2007/0087824 A1 4/2007 Ogiwara
2007/0135204 A1* 6/2007 Nicely ..... 463/17

OTHER PUBLICATIONS

International-Style Search Report issued on Sep. 16, 2010 in the corresponding to Macao Patent Application No. I/933.

* cited by examiner

*Primary Examiner* — Damon Pierce
*Assistant Examiner* — Allen Chan
(74) *Attorney, Agent, or Firm* — Lexyoume IP Meister, PLLC

(57) ABSTRACT

A roulette game machine has a plurality of stations. The roulette game machine accepts a side bet operation carried out by players at the plurality of stations. The roulette game machine accumulatively adds one portion of the gaming values on which a side bet was placed, as a progressive payout. In case of granting a progressive payout, the roulette machine determines a station to which the progressive payout will be granted, from the stations at which the side bet operation has been carried out.

6 Claims, 11 Drawing Sheets

FIG. 11

| FIRST JP LOTTERY TABLE | |
|---|---|
| LOTTERY RESULT | RANDOM NUMBER VALUE |
| WIN FIRST JP PAYOUT | 0~31 |
| LOSE FIRST JP PAYOUT | 32~511 |

FIG. 12

| SECOND JP LOTTERY TABLE | |
|---|---|
| LOTTERY RESULT | RANDOM NUMBER VALUE |
| WIN SECOND JP PAYOUT | 0~63 |
| LOSE SECOND JP PAYOUT | 64~511 |

FIG. 13

| THIRD JP LOTTERY TABLE | |
|---|---|
| LOTTERY RESULT | RANDOM NUMBER VALUE |
| WIN THIRD JP PAYOUT | 0~127 |
| LOSE THIRD JP PAYOUT | 128~255 |

FIG. 14

| STATION | SIDE BET AMOUNT | PLAYER CONTRIBUTION RATE | RANDOM NUMBER VALUE |
|---|---|---|---|
| STATION (1) | 100 | 50% | 0~511 |
| STATION (2) | 50 | 25% | 512~767 |
| STATION (3) | 30 | 15% | 768~911 |
| STATION (4) | 20 | 10% | 912~1023 |

FIG. 15

| STATION | RANDOM NUMBER VALUE |
|---|---|
| STATION (1) | 0~511 |
| STATION (2) | 512~767 |
| STATION (3) | 768~911 |
| STATION (4) | 912~1023 |

GAMING MACHINE

CROSS-REFERENCE TO RELATED APPLICATIONS

This application is based upon and claims a priority from the U.S. provisional Patent Application No. 61/035,150 filed on Mar. 10, 2008, the entire contents thereof are incorporated herein by reference.

BACKGROUND

1. Field

The gaming machine according to one or more aspects of the present invention relates to a gaming machine having a plurality of stations. More particularly, it refers to a gaming machine which can award a progressive payout when a predetermined condition has been satisfied.

2. Description of Related Art

Conventionally, a variety of gaming machines are installed in a gaming hall or the like. These gaming machines include a type of gaming machine which has a plurality of terminals. In such a gaming machine, a plurality of players enter the same game. The players who have entered the game each place a bet of a gaming value and are awarded a prize in accordance with a game result. If the game result satisfies a special condition, the players can be awarded a special prize.

One type of such a special prize which is awarded to the players is a progressive payout. This progressive payout corresponds to an amount of gaming values which have been accumulatively added based on the bet of a gaming value placed by the player.

The present invention provides a gaming machine capable of executing a game having game characteristics which could not be successfully achieved in the above-described conventional art. Specifically, the present invention provides a gaming machine capable of improving a payout rate with respect to a normal prize, and at the same time adopting a "progressive payout" as a special prize.

SUMMARY

The gaming machine according to one or more aspects of the present invention has a plurality of terminals, a storage device and a processor. The processor accepts bets of a gaming value that the players placed using the terminals and determines a game result for the players. The player gets a normal prize based on the game result that has been determined and the amount of gaming values that has been bet. Also, the processor accepts a side bet of a gaming value placed by the players. A predetermined ratio of the gaming values on which the players have placed a side bet is accumulatively added in the storage device. The processor carries out a lottery targeting the terminal(s) at which the side bet(s) was(were) placed. That is to say, the player(s) who placed the side bet is the target of this lottery. The processor awards a special prize (e.g., progressive payout) corresponding to the gaming values which have been accumulatively added in the storage device, with respect to the terminal(s) that has(have) won the lottery. Thus, this gaming machine can provide new game characteristics which could not be successfully achieved in the conventional art.

The gaming machine according to one or more aspects of the present invention has a plurality of terminals, a storage device that has a plurality of storage areas and a processor. The processor accepts bets of a gaming value that the players placed using the terminals and determines a game result for the players. The player gets a normal prize based on the game result that has been determined and the amount of gaming values that has been bet. Also, the processor accepts a side bet of a gaming value placed by the players. A predetermined ratio of the gaming values the players have placed as a side bet is accumulatively added in each of the plurality of storage areas formed in the storage device. In case of side bet is placed, the processor carries out a lottery targeting the terminal(s) at which the side bet(s) was(were) placed. That is to say, the target of this lottery is the player(s) who placed the side bet. A storage area is identified from among the plurality of storage areas formed in the storage device by this lottery. If the player has won this lottery, the player gets a special prize (e.g., progressive payout) corresponding to amount of the gaming value which has been accumulatively added in the storage area identified by the lottery result. Thus, this gaming machine can provide new game characteristics which could not be successfully achieved in the conventional art. Also, this gaming machine can award plural types of the progressive payouts as special prize.

The gaming machine according to one or more aspects of the present invention has a plurality of terminals, a wheel, a winning number detection device, a storage device and a processor. The processor accepts bets of a gaming value that the players placed using the terminals and determines a game result for the players. The player places a bet of gaming value on a number pocket formed in the wheel, designating an identification number. The processor starts rolling of a ball on the wheel and makes detect the winning number detection device the identification number of the number pocket in which the ball has landed. That is, the processor determines a game result to the player based on the winning number detected by the winning number detection device and the identification number on which a bet has been placed. The player get a normal prize based on the game result that has been determined and the amount of gaming values that has been bet. Also, the processor accepts a side bet of a gaming value placed by the players. A predetermined ratio of the gaming values the players have placed as a side bet is accumulatively added in each of the plurality of storage areas formed in the storage device. In case of side bet is placed, the processor carries out a lottery targeting the terminal(s) at which the side bet(s) was(were) placed. That is to say, the player(s) who placed the side bet is the, target of this lottery. A storage area is identified from among the plurality of storage areas formed in the storage device by this lottery. If the player has won this lottery, the player gets a special prize (e.g., progressive payout) corresponding to amount of the gaming value which has been accumulatively added in the storage area identified by the lottery result. Thus, this gaming machine can provide a roulette game machine with new game characteristics which could not be successfully achieved in the conventional art. Also, this gaming machine can award plural types of the progressive payouts as a special prize.

BRIEF DESCRIPTION OF THE DRAWINGS

FIG. 11 is an explanatory diagram showing one example of a first JP lottery table;

FIG. 12 is an explanatory diagram showing one example of a second JP lottery table;

FIG. 13 is an explanatory diagram showing one example of a third JP lottery table;

FIG. 14 is an explanatory diagram showing a specific example relating to a target terminal determination table based on a side bet amount; and FIG. 15 is an explanatory diagram showing one example of a target terminal determination table.

DETAILED DESCRIPTION

Figure 1:
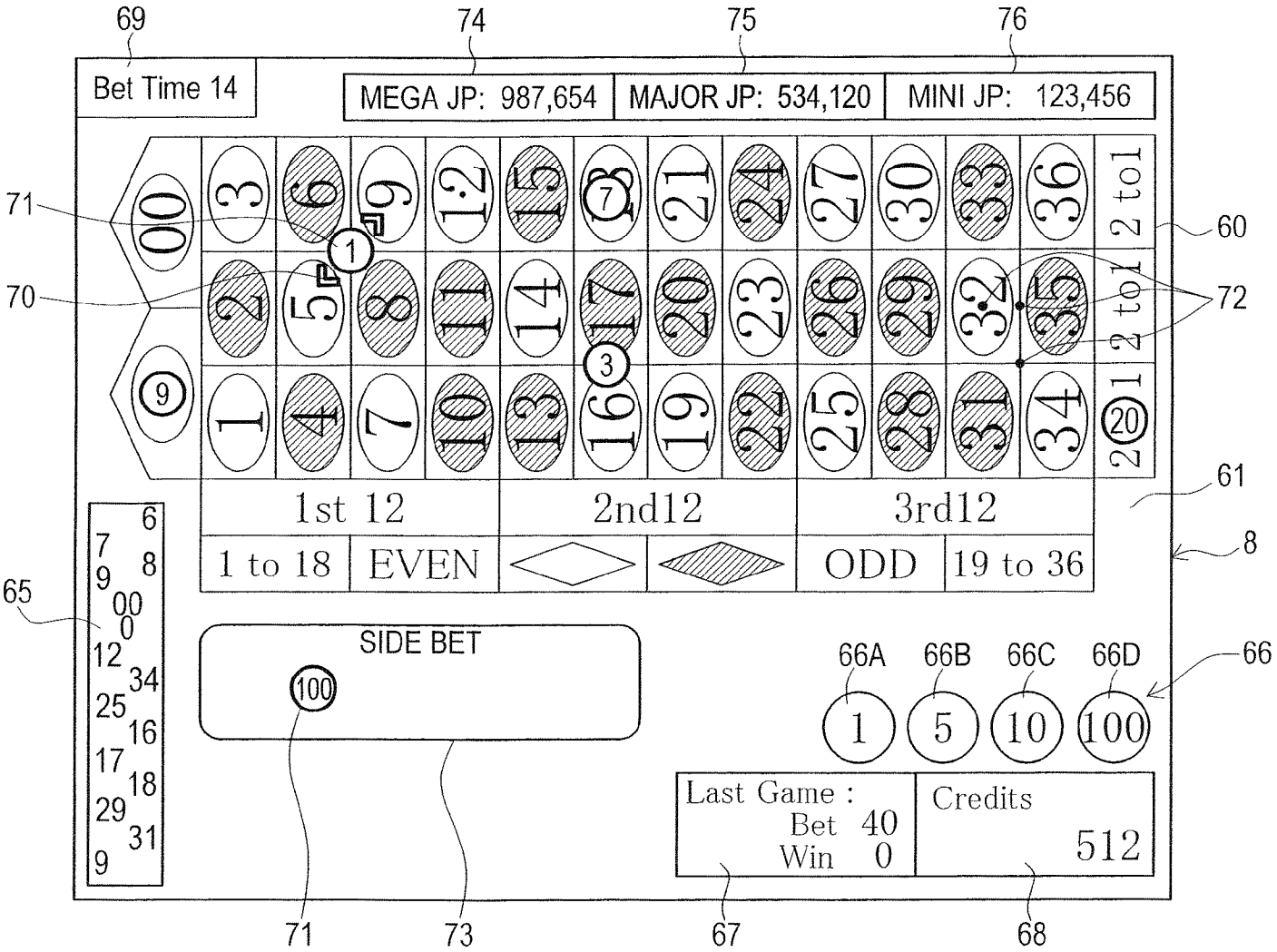
FIG. 1 is an explanatory diagram showing characteristics of a roulette game machine according to one embodiment of the present invention.

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine, a server, and a game system according to one or more aspects of the invention will be described in detail with reference to the drawings based on an embodiment embodying one or more aspects of the invention. However, it is appreciated that one or more aspects of the present invention may be embodied in distributable (via CD and the like) or downloadable software games, console games, and the like. In this regard, the slot machine may be a virtual slot machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU", "processor", and "controller" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

Next, a detailed description will be given with respect to a gaming machine according to the present invention, based on an embodiment relating to a roulette game machine 1, while referring to the accompanying drawings.

Generally, in the roulette game machine, a player first bets a player-owned gaming value on a number or the like that will be selected by lottery in the roulette. If the number that was betted wins, the player is awarded a prize in accordance with the gaming value bet.

Here, the characteristics of a roulette game machine 1 will be described. As shown in FIG. 1, in a roulette game machine 1, the player places a side bet of a gaming value as he/she pleases. If the side bet is placed, the roulette game machine 1 accumulatively adds a portion (a predetermined ratio) of the gaming value on which the side bet was placed (refer to FIG. 1). The gaming value that was accumulatively added following the side bet can be awarded to the player as a progressive payout (e.g., JACKPOT). The progressive payout can be awarded only to the player who placed the side bet. More specifically, with the above configuration, the roulette game machine 1 can award to the player a higher progressive payout.

Figure 2:
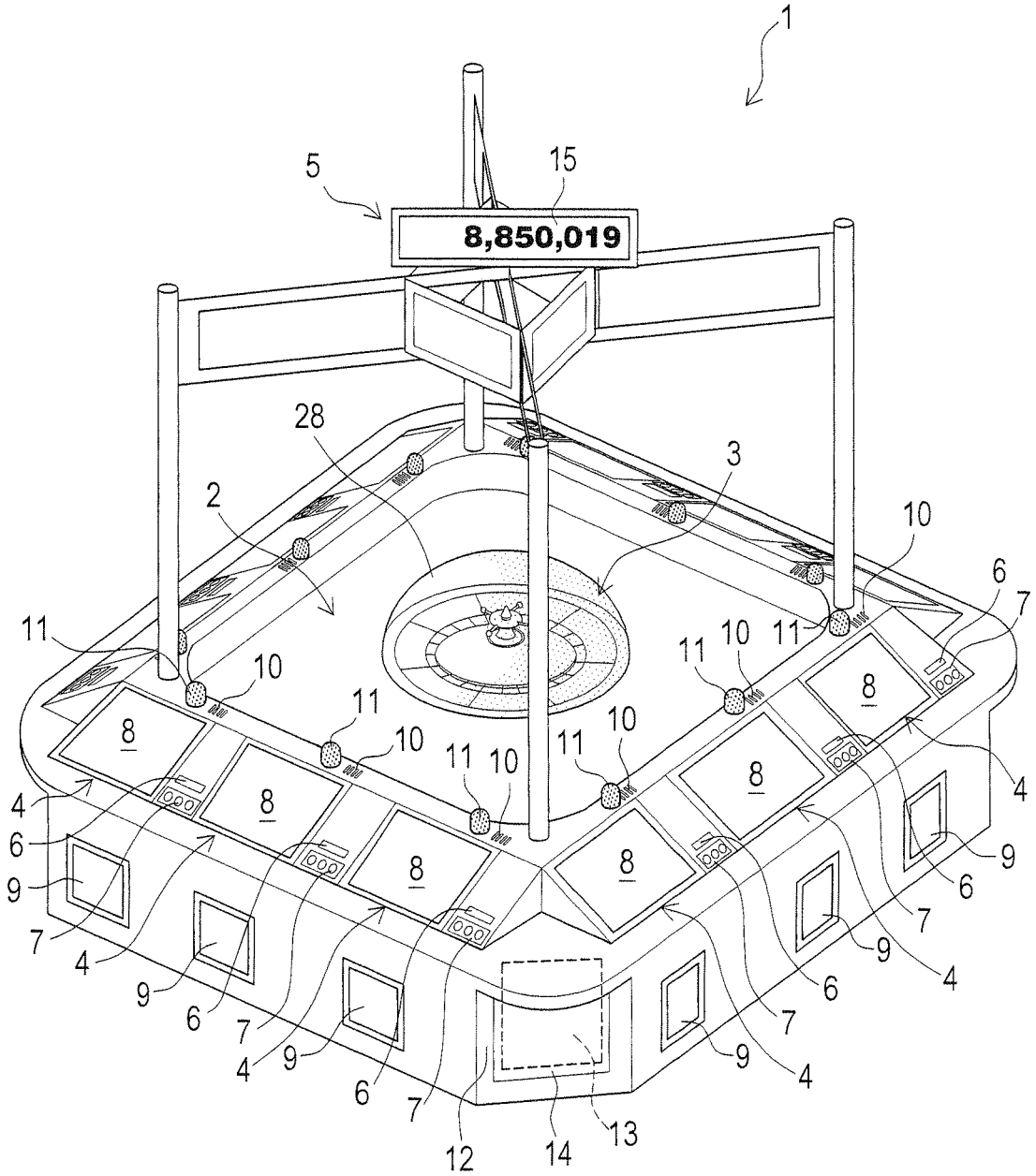
FIG. 2 is a perspective view showing an outer appearance of the roulette game machine.

Next, a schematic configuration of the roulette game machine 1 will be described in detail while referring to the drawings. FIG. 2 is a perspective view showing an outer appearance of a schematic configuration of the roulette game machine 1.

As shown in FIG. 2, the roulette game machine 1 has a cabinet 2, a roulette 3, a plurality (in the present embodiment, 12) of stations 4 and an electro-luminescence display unit 5. The cabinet 2 forms a main portion of the roulette game machine 1. The roulette 3 is installed substantially at the center on an upper face of the cabinet 2. The roulette 3 is used to determine the game results (i.e. the winning number as will be described later) for the roulette game. Each station 4 is installed at the periphery of the roulette 3. The electro-luminescence display unit 5 is a display device installed at an upper side of the cabinet 2.

Stations 4 are used by the player in the bet operation with respect to the winning number on the roulette 3. The stations 4 are also used by the player in the side bet operation. That is to say, the stations 4 accept a bet operation and a side bet operation carried out by the player. A station 4 has a medal insertion slot 6, a control unit 7 and an image display 8. The medal insertion slot 6 accepts coins and gaming media (for instance, chips and medals to be used for the game) which have been inserted by the player. The control unit 7 has a plurality of control buttons and the like. Thus, a player can input an arbitrary command by operating the control unit 7. The image display 8 is adapted to display an image with respect to the game. Accordingly, the player can operate the control unit 7 and the like based on the display on the image display 8.

The cabinet 2 has a plurality of medal payout openings 9 installed at a side face thereof. The positioning of each medal payout opening 9 respectively corresponds to the positioning of each station 4. Further, a speaker 10 is installed at a right upper side of the image display 8 in each station 4. The speaker 10 outputs music, sound effects and the like in accordance with the progress of the game.

Further, a WIN lamp 11 is respectively positioned at an upper side of the image display 8 of each station 4. If the number (in the present embodiment, "00", "0", "1" through "36") that was betted at a station 4 has won, the WIN lamp 11 of that station 4 lights up. Further, if the player is awarded a JACKPOT (hereinafter referred to as JP) as will be described later, the WIN lamp 11 of the station 4 which is being used by the player lights up in a similar manner. The roulette game machine 1 can award tree types of JPs (a first JP, a second JP and a third JP). When any of these tree types of JPs are awarded, the WIN lamp 11 at the station 4 lights up.

The medal insertion slot 6 has a medal sensor (not shown) installed inside. The medal sensor discriminates the gaming media such as medals and the like which have been inserted from the medal insertion slot 6. This medal sensor counts the number of medals inserted. The medal payout opening 9 has a hopper (not shown) installed inside. The hopper pays out a predetermined number of medals to the medal payout opening 9.

The cabinet 2 has a corner portion 12 formed at a corner thereof. The corner portion 12 has a server 13 as will be described later. The server 13 is installed inside the corner portion 12. A corner door 14 is mounted in the corner portion 12. Generally, the corner door 14 is shut by a locking mechanism. In this case, the server 13 is never operated by the player. The corner door 14 is opened by unlocking the locking mechanism. In this case, the server 13 installed inside the corner portion 12 is in an operable state. Accordingly, the maintenance staff of the roulette game machine 1 can perform a variety of setting operations with respect to the roulette game machine 1, by operating the server 13.

The electro-luminescence display unit 5 has a JP amount display portion 15. The JP amount display portion 15 displays three types of JP amounts as was described earlier. As was described, the roulette game machine 1 has three types of JPs, including a first JP, a second JP and a third JP. Accordingly, the JP amount display portion 15 displays, in turn, a first JP amount, a second JP amount and a third JP amount.

Here, the roulette game machine 1 accumulatively adds a predetermined ratio of the gaming values on which the player has placed a side bet in a storage area formed in a JP accumulation storage area 87 that will be described later. The gaming value amount that was accumulatively added here is awarded as JP with respect to that station 4.

The first JP (MEGA JACKPOT) is constituted by accumulatively adding 3% of the gaming values on which the player has placed the side bet. The default value for the first JP is "2000". The second JP (MAJOR JACKPOT) is constituted by accumulatively adding 2% of the gaming values on which the player has placed the side bet. The default value for the second JP is "1500". The third JP (MINI JACKPOT) is constituted by accumulatively adding 1% of the gaming values on which the player has placed the side bet. The default value for the third JP is "1000".

Figure 3:
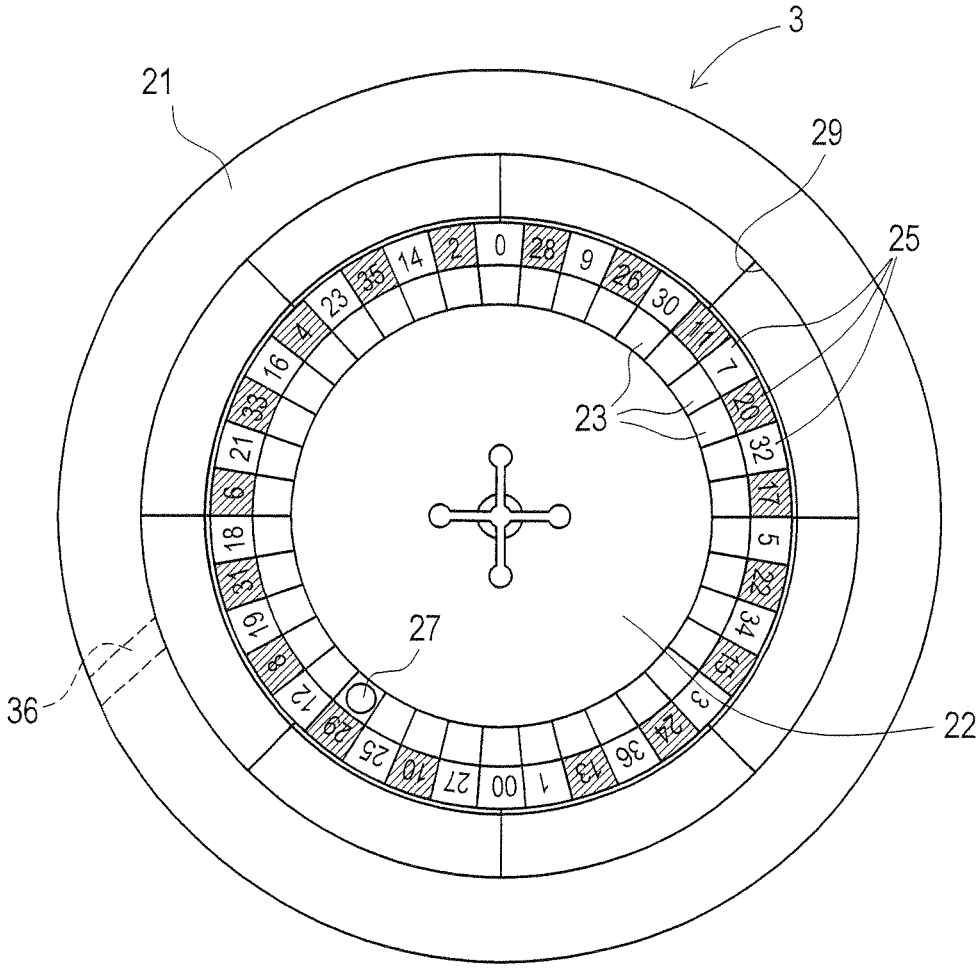
FIG. 3 is an explanatory diagram showing a configuration of a roulette.

Next, the configuration of the roulette 3 will be described in detail while referring to the drawings. FIG. 3 is an explanatory diagram showing a configuration of the roulette 3 according to the present embodiment.

As shown in FIG. 3, the roulette 3 has a frame 21 and a wheel 22. The frame 21 securely mounts the roulette 3 on an upper face of the cabinet 2. The disk-shaped wheel 22 is placed inside the frame 21. This wheel 22 is rotatably supported inside the frame 21.

The wheel 22 has a plurality of (in the present embodiment, 38) number pockets 23. Each number pocket 23 is formed in a concave shape on the upper face of the wheel 22. Each number pocket 23 is arranged along an outer margin of the wheel 22. A number display board 25 is arranged adjacent to each of the number pockets 23 (refer to FIG. 3). The number display boards 25 display numbers (e.g., any number from "00", "0", "1" through "36") showing the number pocket 23 corresponding to the number display board 25. That is, the wheel 22 has thirty-eight number pockets 23 to each of which one of the numbers from amongst "00", "0", "1" through "36" is assigned.

A ball throw-in opening 36 is formed inside the frame 21. The ball throw-in opening 36 is coupled to a ball throw-in device (not shown). Accordingly, the roulette game machine 1 throws in a ball 27 from the ball throw-in opening 36 onto the wheel 22 by driving the ball throw-in device. The upper side of the roulette 3 is covered by a cover member 28. The cover member 28 is made up of a hemispherical transparent acrylic resin.

Figure 5:
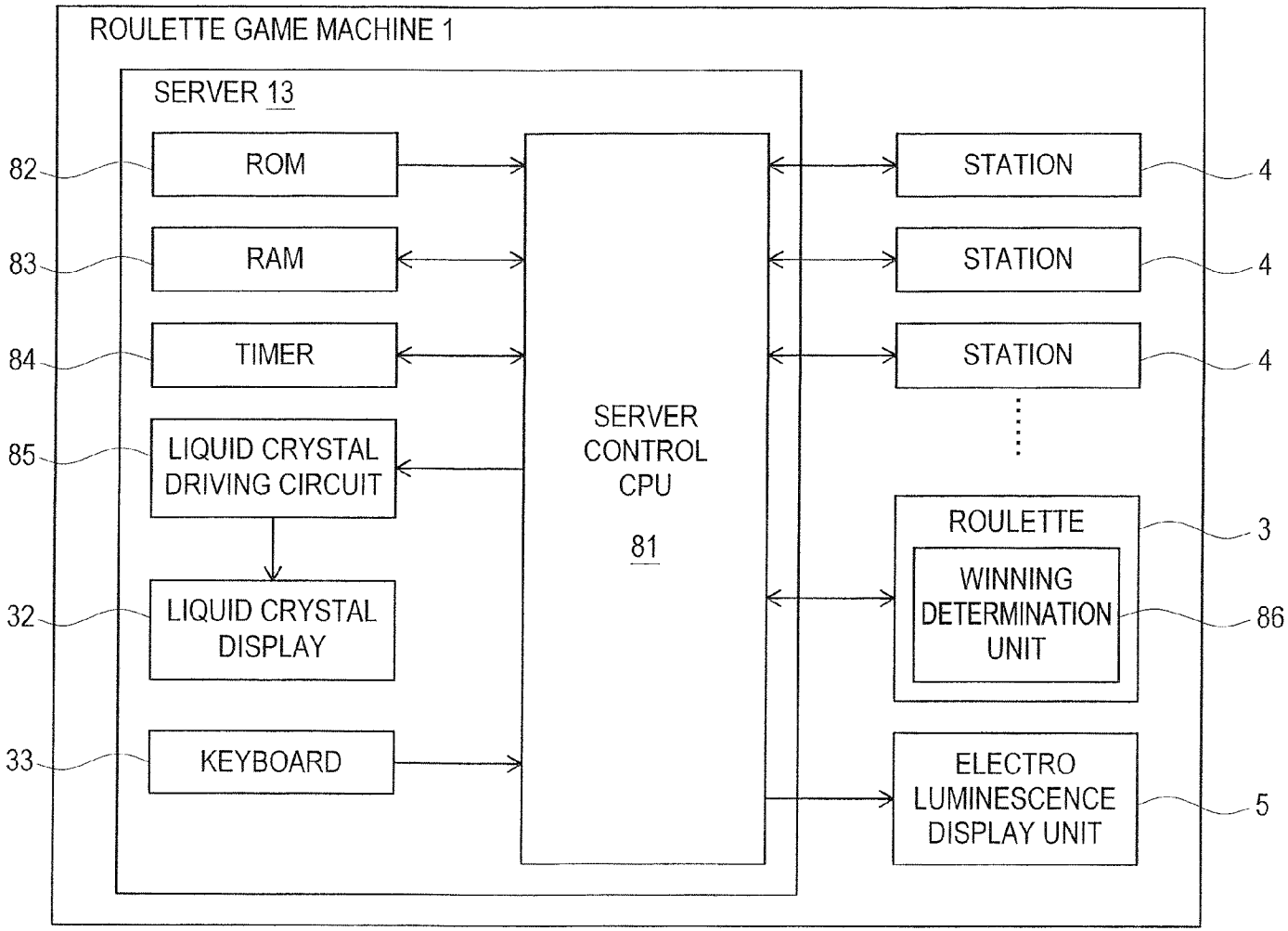
FIG. 5 is a block diagram showing a control system of the roulette game machine.

A winning determination unit 86 (refer to FIG. 5) and a ball retrieval unit are installed at a lower side of the wheel 22. The winning determination unit 86 determines the number pocket 23 in which the ball 27 has landed. The ball retrieval unit retrieves the ball 27 on the wheel 22 at the end of the game. The ball insertion unit, the winning determination unit and the ball retrieval unit are already known in the art. Accordingly, further detailed description thereof is hereby omitted.

The frame 21 has a slanted surface which slopes gently towards the center of the roulette 3. A guide wall 29 is formed at an intermediate portion of this slanted surface. The guide wall 29 guides the ball 27 that was thrown in against the centrifugal force. Accordingly, the thrown-in ball 27 rolls along the guide wall 29. Then, the ball 27 tumbles down the slanted surface of the frame 21 towards an inner side thereof. Here by, the ball 27 reaches the wheel 22 which is rotating.

The ball 27 lands in any one of the number pockets 23 after passing on the number display board 25 of the wheel 22. If the ball 27 lands in the number pocket 23, the winning determination unit 86 identifies the number of the number display board 25 corresponding to the number pocket 23 in which the ball 27 has landed. The number identified by the winning determination unit 86 becomes the winning number.

Figure 4:
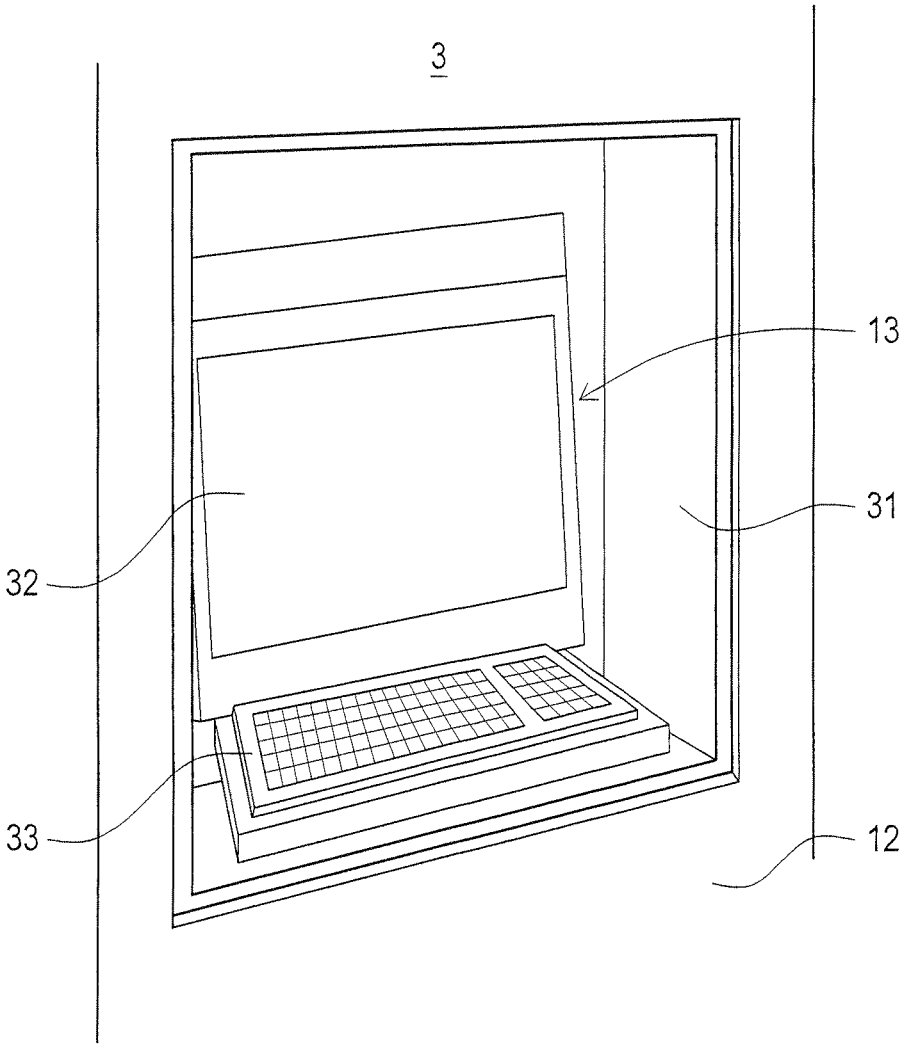
FIG. 4 is a perspective view showing a server of the roulette game machine.

Next, a server 13 installed in the roulette game machine 1 will now be described while referring to the accompanying drawings. FIG. 4 is a perspective view showing the server 13 of the roulette game machine 1.

FIG. 4 is a view showing the corner portion 12 in a state where the corner door 14 is open. The server 13 is housed inside a room 31 formed in a wall face of the cabinet 2.

The server 13 is connected with each station 4. Accordingly, the server 13 can transmit a command signal to each station 4. Thus, the server 13 can initiatively control each station 4 by transmitting the command signal. Accordingly, the server 13 controls the overall roulette game machine 1. That is, the server 13 performs control with respect to the progress of the game in the roulette game machine 1. The server 13 also carries out control with respect to maintenance of the roulette game machine 1.

As shown in FIG. 4, the server 13 has a liquid crystal display 32 and keyboard 33. On the liquid crystal display 32 are displayed a menu screen (not shown) and a maintenance screen (not shown). The keyboard 33 is operated by maintenance staff when a variety of setting activities and maintenance activities are carried out with respect to the roulette game machine 1.

Next, the configuration of the control unit 7 and the image display 8 installed in the station 4 will be described.

As shown in FIG. 2, the control unit 7 is installed at a side of the image display 8. The control unit 7 has a plurality of operation buttons. The plurality of operation buttons are made of a BET determination button 47, a CASHOUT button 48 and a HELP button 49.

The BET determination button 47 is operated upon determining a target of the bet (for instance, a number corresponding to the number pocket 23) and an amount of gaming values that were betted. Accordingly, the player operates the BET determination button 47 after the bet operation to be described later is carried out. When the BET determination button 47 is depressed, the contents of the bet operation carried out by the player (e.g., the target of the bet and the bet amount) become active as bets with respect to the game. This BET determination button 47 is also operated for placing a side bet.

The CASHOUT button 48 is operated upon requesting payout of the credits that the player possesses. When the CASHOUT button 48 is depressed, medals corresponding to the credit that the player possesses are paid out to the medal payout opening 9. Here, one credit corresponds to one medal.

The HELP button 49 is operated when the game operation method and the like are unclear. Once the HELP button 49 is depressed, a help screen is displayed on the image display 8. The help screen reports to the player a variety of types of information (for instance, the operation method and the like in the roulette game machine 1).

The image display 8 is a so-called touch panel-type liquid crystal display. Specifically, the image display 8 has a touch panel 50 installed at a front face thereof. Accordingly, the player can select an icon displayed on the image display 8, by depressing the specific icon with his/her finger.

Next, the BET screen 61 which is displayed on the image display 8 at the time of executing the roulette game will now be described in detail while referring to the drawings.

As shown in FIG. 1, the BET screen 61 includes a betting board 60. If the BET screen 61 is displayed, the player can bet the credits he/she possesses by operating the touch panel 50.

On the betting board 60 are displayed thirty-eight numbers, namely "0", "00", and "1" through "36", in respective squares arranged in a grid. Each number on the betting board 60 corresponds to a number in the above-described number pocket 23. The betting board 60 has a plurality of special BET areas. The special BET areas are selected when an "odd number", "even number", "color of the number display board (red or black)" and "a predetermined number range (for instance, "1" through "12", etc.)" are selected as target of the bet. The above-described special BET areas are arranged in a grid shape as well.

A result history display portion 65, a unit BET button 66, a payout result display portion 67, a credit amount display portion 68 and a side bet area 73 are formed at a lower side of the betting board 60.

The result history display portion 65 display a history of the winning numbers in the games up to the previous game. The result history display portion 65 reports to the player the winning numbers for the past 16 games. Here, one game in the roulette game machine 1 is constituted of a sequence of operations including, in turn, betting of gaming values, throwing in and rolling of the ball, determining the winning number and awarding the prize. At the end of one game, the result history display portion 65 adds the winning number which have been newly determined.

The unit BET button 66 is operated at the time of setting the amount of gaming values (credits) to be bet with respect to the bet area 72 designated by the player. The bet area 72 indicates a grid of numbers and marks, or a line forming the grid. The unit BET button 66 is made up of a 1-BET button 66A, a 5-BET button 66B, a 10-BET button 66C and a 100-BET button 66D.

The 1-BET button 66A is operated by the player at the time of increasing, by "1", the amount of gaming values which was bet on the designated bet target (for instance, bet area 72). The 5-BET button 66B is operated by the player at the time of increasing, by "5", the amount of gaming values which was bet on the designated bet target. Similarly, the 10-BET button 66C and the 100-BET button 66D are operated by the player at the time of increasing the amount of gaming values to be bet by "10" and "100", respectively. That is, the amount of gaming values which have been bet on a bet target is sequentially increased, in accordance with the kind of unit BET button 66 that was operated by the player. Accordingly, the player bets a large amount of gaming values on a designated bet target, by means of a simple operation.

The payout result display portion 67 reports to the player the bet amount placed by the player and the credit amount paid out in the previous games.

The credit amount display portion 68 displays the credit amount that the player currently possesses. If credits have been betted, this credit amount is decreased in accordance with the bet amount (1 credit for 1 bet). In case of a credit payout, the credit amount is increased in accordance with the credit amount for the payout amount. If the number of credits that the player possesses has become 0, the game ends.

The side bet area 73 shows a bet target which is selected at the time the player places a side bet. The player can bet a desired gaming value amount as side bet, by operating the unit BET button 66 in a state where this side bet area 73 is selected. In case the side bet has been placed, a chip mark 71 to be described later is displayed on this side bet area 73.

A BET TIME display portion 69 is provided at an upper side of the betting board 60. The BET TIME display portion 69 displays the remaining time for the period in which players' bets are allowed (hereinafter referred to as bet period). When the bet period starts, the BET TIME display portion 69 displays "20". Then, with the lapse of each 1 second, the number value which was displayed on the BET TIME display portion 69 is decreased by 1. The BET TIME display portion 69 shows end of the bet period by displaying the number value "0".

Further, a first JP display portion 74, a second JP display portion 75 and a third JP display portion 76 are formed at a right side of the BET TIME display portion 69. The first JP display portion 74, the second JP display portion 75 and the third JP display portion 76 respectively display gaming value amounts which have been accumulated till the present, as the first JP (MEGA JACKPOT) through third JP (MINI JACKPOT). The number value displayed on the first JP display portion 74 corresponds to the contents stored in the first JP accumulation storage area 87A to be described later. The number value displayed on the second JP display portion 75 corresponds to the contents stored in the second JP accumulation storage area 87B to be described later. The number value displayed on the third JP display portion 76 corresponds to the contents stored in the third JP accumulation storage area 87C to be described later. In case of a JP (for instance, first JP) payout, the number value on the JP display portion (first JP display portion 74) corresponding to the JP that was paid out shows a default value (2000). As was described earlier, the amount of gaming values which have been accumulatively added as the first JP through the third JP are also displayed on the JP amount display portion 15 (refer to FIG. 2) of the electro-luminescence display unit 5.

A cursor 70 and a chip mark 71 are displayed on the betting board 60. The cursor 70 shows a bet area 72 which is currently selected by the player. The chip mark 71 shows the bet target currently bet by the player (for instance bet area 72) and the amount of gaming values (credits) which are bet as the bet target at present. For instance, in the case shown in FIG. 1, the chip mark 71 displayed on the grid of number "18" shows that 7 chips have been betted on number "18". The bet method in which only one number is the target of bet is referred to as "straight bet".

In the roulette game machine 1, the player uses the touch panel 50 to set the bet target in a variety of bet methods. Specifically, the player can set the bet target based on "corner bet", "split bet", "street bet", "five bet", "line bet", "column bet" and "dozen bet", in addition to a "straight bet". Further, in the roulette game machine 1, the player can set the bet target by using six squares provided at the lowermost level of the betting board 60. That is to say, the player can set 18 numbers as bet target, based on "the color on the number display board 25 (red) or (black)", "odd or even numbers", "number 18 or lower, or 19 or higher".

The setting operation of these bet targets is similar to that for the roulette game which has been conventionally carried out. Accordingly, a detailed description of this method will hereby be omitted.

Next, the procedure of the bet operation in the roulette game machine 1 will be described. The player directly depresses by finger the portion of the touch panel 50 corresponding to the desired bet area 72 (the grid for the number and mark, or the line forming the grid), with the BET screen 61 displayed on the image display 8. The bet area 72 that player desires is selected as bet target by operating the touch panel 50. At this time, the cursor 70 is moved on the selected bet area 72.

Then, the player operates the unit BET buttons 66 (1-BET button 66A, 5-BET button 66B, 10-BET button 66C and 100-BET button 66D) until a desired credit amount is reached. As a result, the player can set the credit amount to be betted as the selected bet target. The contents of the above-described bet operation are determined by depressing the BET determination button 47.

Next, the procedure of the side bet operation in the roulette game machine 1 will be described. In the case a side bet is placed, the player directly depresses by finger the portion of the touch panel 50 corresponding to the side bet area 73. As a result, the side bet area 73 is set as the bet target. Then, the player operates the unit BET buttons 66 (1-BET button 66A, 5-BET button 66B, 10-BET button 66C and 100-BET button 66D) until a desired credit amount is reached. As a result, the player can set the credit amount (e.g., the side bet amount) to be bet with respect to the side bet area 73. The contents of the above-described side bet operation are determined by depressing the BET determination button 47.

Figure 8:
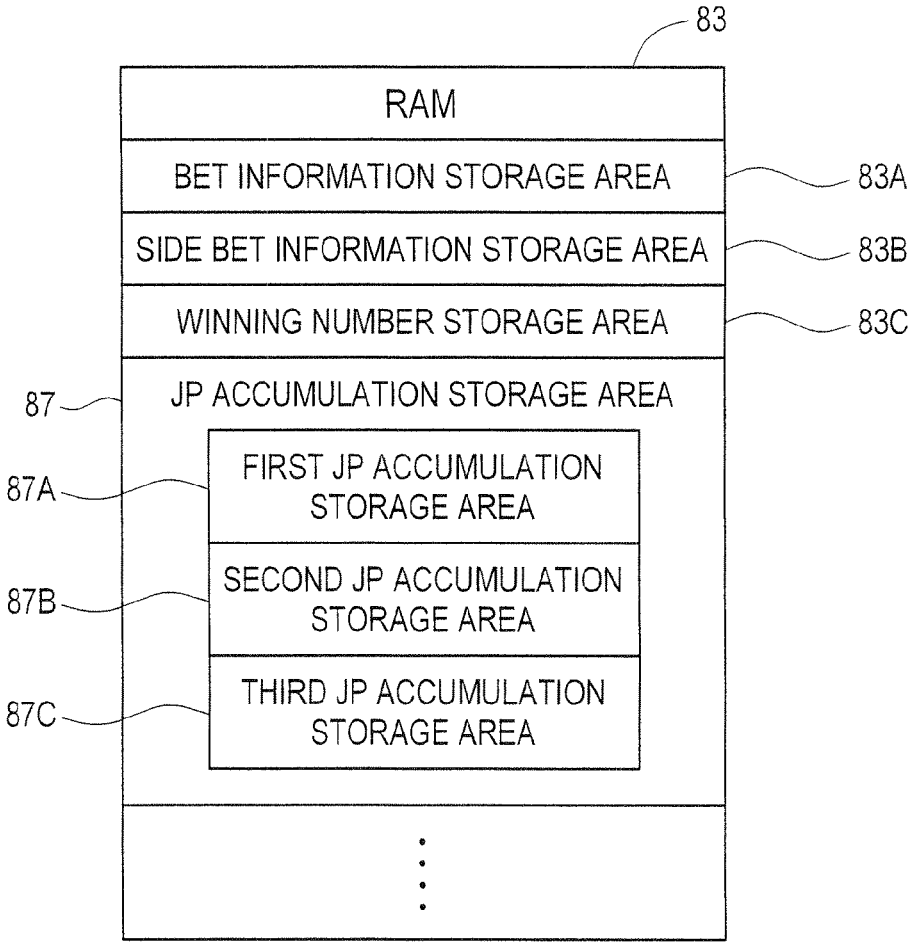
FIG. 8 is an explanatory diagram showing a configuration of a RAM in the roulette game machine.

Next, the configuration of the control system in the roulette game machine 1 will be described in detail while referring to the drawings. FIG. 8 is a block diagram showing the control system of the roulette game machine. As shown in FIG. 8, the roulette game machine 1 is made up of a server 13 and a plurality of (in the present embodiment, 12) stations 4. The plurality of stations 4 are connected with the server 13. Further, server 13 is connected with a roulette 3 and an electroluminescence display unit 5. The control system of each station 4 will be described in detail later.

The server 13 has a server control CPU 81, a ROM 82, a RAM 83, a timer 84, a liquid crystal display 32 connected through the liquid crystal driving circuit 85, and a keyboard 33 (refer to FIG. 4).

The server control CPU 81 is a computation unit and a control unit that controls the overall server 13. The server control CPU 81 carries out a variety of processes based on the control signal and the like inputted from each station 4, and the data and programs stored in the ROM 82 and the RAM 83. The server control CPU 81 initiatively controls each station 4 by transmitting the control signals to the stations 4 based on the above-described process results.

The server control CPU 81 controls a variety of periphery devices which are used in the roulette game. Specifically, the server control CPU 81 controls the launching of the ball 27, the rotation of the wheel 22 and the roulette 3 with respect to identifying the winning number.

The ROM 82 is made up of a semiconductor memory or the like, for instance. The ROM 82 stores a variety of control programs and data with respect to control of the roulette game machine 1. The above-described variety of programs and data include programs for causing execution of basic functions in the roulette game machine 1 and a server side gaming process program as will be described later (refer to FIG. 9 and FIG. 10).

Figure 7:
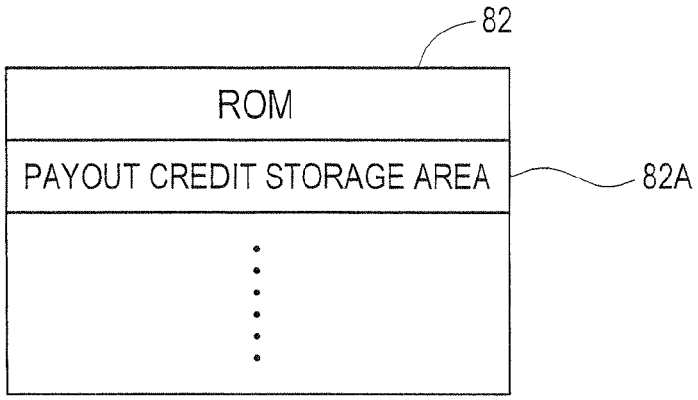
FIG. 7 is an explanatory diagram showing a configuration of a ROM in the roulette game machine.

The ROM 82 has a payout credit storage area 82A (refer to FIG. 7). The payout credit storage area 82A stores a payout magnification rate with respect to the roulette game. The payout magnification rate with respect to the above-described roulette game is "×2" through "×36". The above-described payout magnification rate differs depending on the kind of bet method ("straight bet", "corner bet", "split bet" and the like).

The RAM 83 temporarily stores the computation process results and a variety of kinds of information based on execution of a control program by the server control CPU 81. The RAM 83 has a bet information storage area 83A, a side bet information storage area 83B, a winning number storage area 83C and a JP accumulation storage area 87 (refer to FIG. 8).

The bet information storage area 83A stores players' bet information in the current game (bet target, the amount of the credit that was bet, the kind of bet method). The side bet information storage area 83B stores players' side bet information in the current game (presence or absence of a side bet, the credit amount on which the side bet was placed). The winning number storage area 83C stores the winning number of the roulette 3 that was determined by the winning determination unit 86. The storage contents of the winning number storage area 83C are used for the display on the result history display portion 65 in each station 4.

The JP accumulation storage area 87 stores a pool amount obtained by accumulatively adding a predetermined ratio of the credit amount on which the side bet was placed. As shown in FIG. 8, the JP accumulation storage area 87 has a first JP accumulation storage area 87A, a second JP accumulation storage area 87B and a third JP accumulation storage area 87C.

The first JP accumulation storage area 87A stores a pool amount corresponding to a first JP (MEGA JACKPOT). In case a side bet has been placed, the contents stored in the first JP accumulation storage area 87A are updated to a value obtained by adding an amount corresponding to 3% of the credit amount on which the side bet was placed with respect to the current pool amount.

The second JP accumulation storage area 87B stores a pool amount corresponding to the second JP (MAJOR JACKPOT). In case of a side bet, the contents stored in the second JP accumulation storage area 87B are updated to a value obtained by adding an amount corresponding to 2% of the credit amount on which the side bet was placed with respect to the current pool amount.

The third JP accumulation storage area 87C stores a pool amount corresponding to the third JP (MINI JACKPOT). In case a side bet is placed, the contents stored in the third JP accumulation storage area 87C are updated to a value obtained by adding an amount corresponding to 1% of the credit amount on which the side bet was placed with respect to the current pool amount.

Further, the server control CPU 81 is connected with a timer 84. The timer 84 is a timing unit that measures the time. The time information of the timer 84 is used in determining the lapse of the bet period. Also, based on the time information of the timer 84, the server control CPU 81 controls the rotation operation of the wheel 22 and throw in of the ball 27.

The server control CPU 81 is connected with the electro-luminescence display portion 5. Accordingly, the server control CPU 81 can carry out effects through the electrical lamps installed in the electro-luminescence display portion 5 by controlling light emitting means in the LED and the like. The server control CPU 81 controls the JP amount display portion 15 based on the contents stored in the JP accumulation storage area 87. As a result, the JP amount display portion 15 can sequentially display a first JP amount, a second JP amount and a third JP amount which have been accumulated till present.

Figure 6:
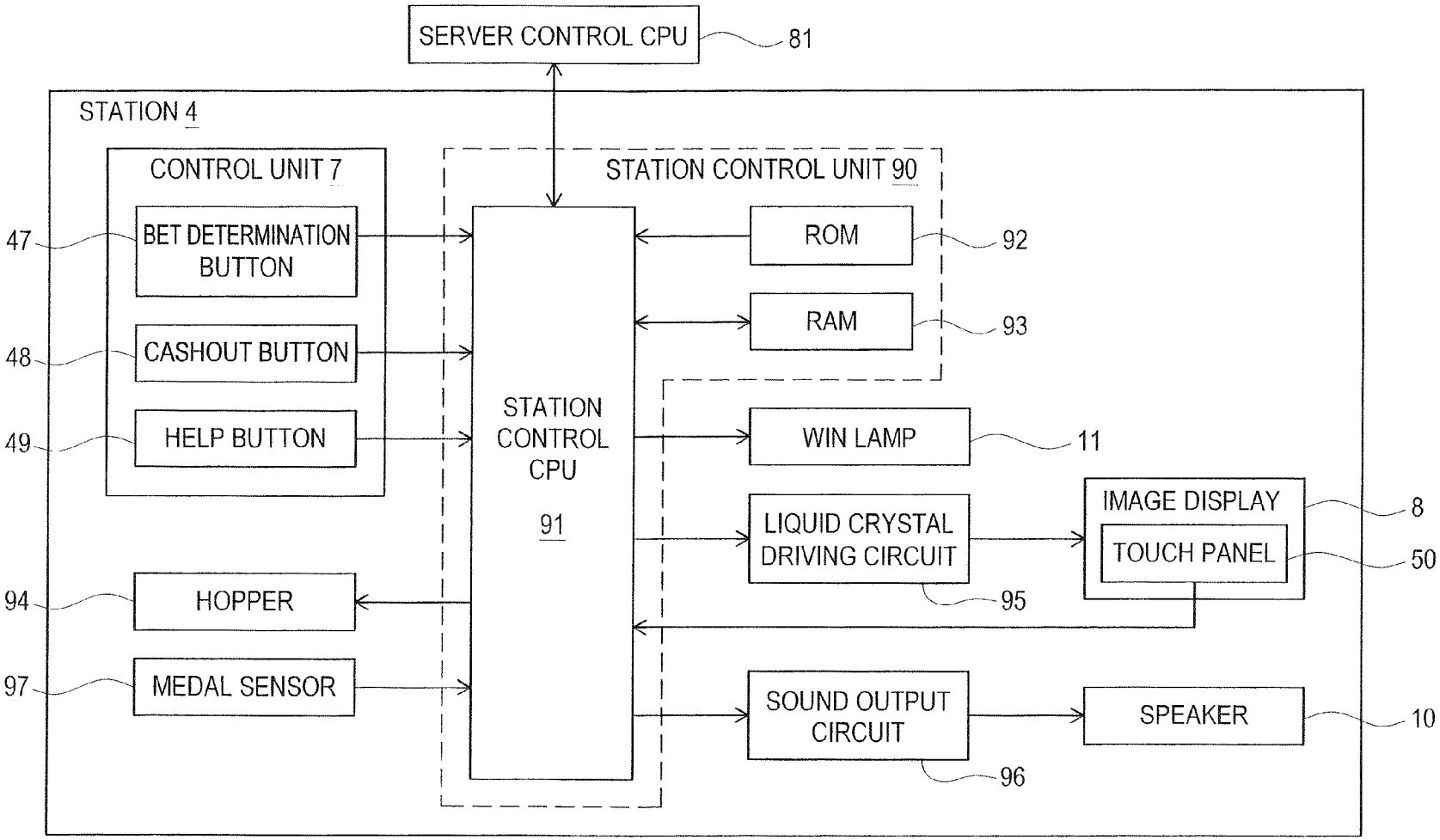
FIG. 6 is a block diagram showing a control system of a station.

Next, the configuration of the control system in each station 4 will be described in detail while referring to the accompanying drawings. FIG. 6 is a block diagram showing a control system in each station 4. The stations 4 constituting the roulette game machine 1 have basically the same configuration. Accordingly, the control system in only one station 4 will be described.

As shown in FIG. 6, the station 4 is constituted of a station control unit 90 and a variety of periphery devices. The station control unit 90 has a station control CPU 91, a ROM 92 and a RAM 93.

The station control CPU 91 is a computation unit and a control unit that executes control with respect to the roulette game in station 4. The station control CPU 91 executes various processes based on the data and programs stored in the ROM 92 and the like. The station control CPU 91 controls each periphery device constituting the station 4 in response to a control signal sent from the server control CPU 81 and an operation signal based on the players' operation. Thus, the roulette game in station 4 advances.

The ROM 92 is made up of a semiconductor memory or the like, for instance. The ROM 92 stores various programs and data required for controlling the station 4. The various programs and data include programs and data tables for causing execution of the basic functions in the stations 4. The ROM 92 stores a station side game process program as will be described later (refer to FIG. 9 and FIG. 10).

The RAM 93 temporarily stores information and the like required for controlling the stations 4. Specifically, the RAM 93 temporarily stores the computation results of the station control CPU 91, the credit amount that the player currently possesses, the betting state of the player, and the like.

The station control CPU 91 is connected with the respective operation buttons (e.g., the BET determination button 47, the CASHOUT button 48 and the HELP button 49) that constitute the control unit 7. Accordingly, the station control CPU 91 can receive an operation signal outputted by operating the respective operation button. Thus, the station control CPU 91 can control execution of corresponding operations based on the above-described operation signal.

The station control CPU 91 is connected with a hopper 94. The hopper 94 pays out a predetermined number of medals to the medal payout opening 9 (refer to FIG. 2) in response to a control signal from the station control CPU 91.

Further, the station control CPU 91 is connected with the image display 8 through the liquid crystal driving circuit 95.

The liquid crystal driving circuit 95 is used for controlling display on the image display 8. This liquid crystal driving circuit 95 has a program ROM, an image ROM, an image control CPU, a work RAM, a VDP (video display processor) and a video RAM and the like. The image control CPU and the like constituting the liquid crystal driving circuit 95 are heretofore known in the art, and thus, further description thereof is hereby omitted.

As was described earlier, the image display 8 has a touch panel 50 mounted at a front face thereof. This touch panel 50 is connected with the station control CPU 91. The operation signal of the touch panel 50 is transmitted to the station control CPU 91. Accordingly, if a bet operation or a side bet operation has been carried out using the this touch panel 50, the station control CPU 91 can generate bet information or side bet information in response to the operation signal corresponding to the bet operation and the like.

The bet information or side bet information thus generated is transmitted to the server control CPU 81 and is stored in the bet information storage area 83A or side bet information storage area 83B, respectively.

Further, the station control CPU 91 is connected with the sound output circuit 96 and speaker 10. When the various effects are carried out, the speaker 10 outputs a variety of sound effects in response to the output signal from the sound output circuit 96.

The station control CPU 91 is connected with the medal sensor 97. The medal sensor 97 detects the medals which have been inserted from the medal insertion slot 6 (FIG. 2). The medal sensor 97 counts the medals that have been inserted and then transmits the count result to the station control CPU 91. Accordingly, the station control CPU 91 can increase the credit amount that the player possesses and are stored inside the RAM 93, based on the above-described count results.

The station control CPU 91 is connected with the WIN lamp 11. Accordingly, in case of a payout to the player, the station control CPU 91 can cause the WIN lamp 11 to light up in a predetermined color.

Figure 9:
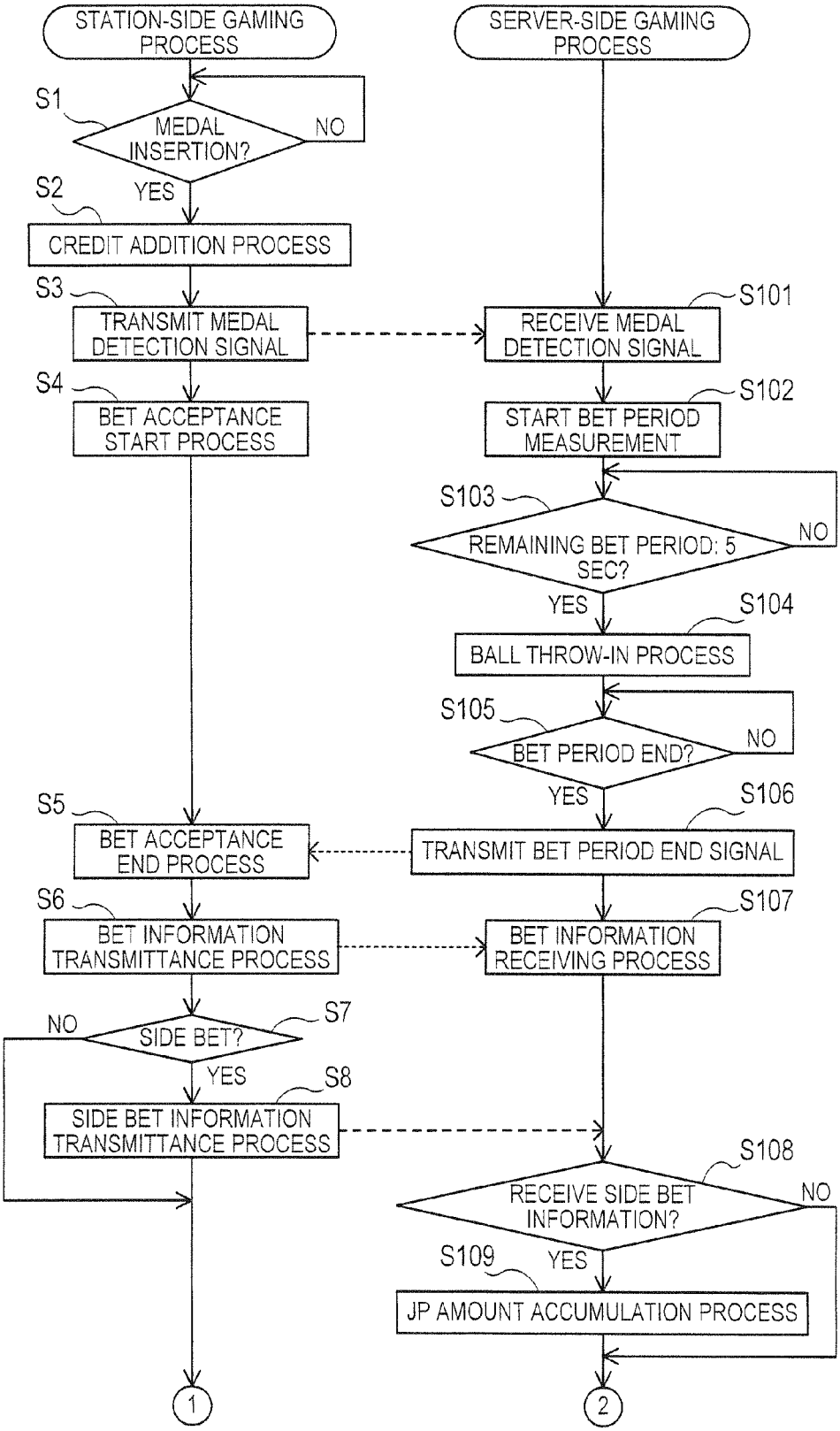
FIG. 9 is a flow chart (1) of a game process program for the roulette game machine.
Figure 10:
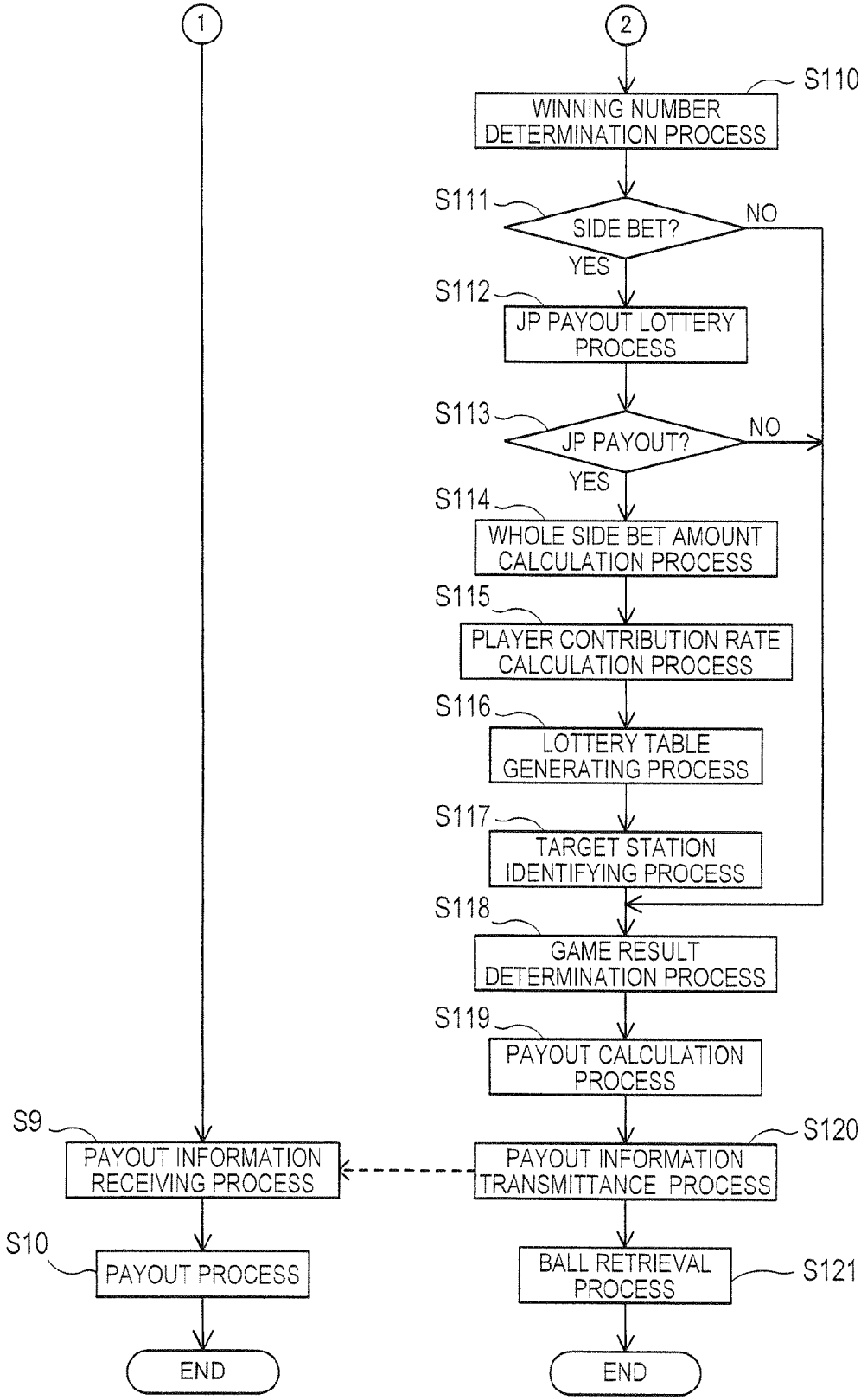
FIG. 10 is a flow chart (2) of a game process program for the roulette game machine.

Next, the game process program of the roulette game machine 1 according to the present embodiment will be described in detail while referring to the drawings. FIG. 9 and FIG. 10 are flow charts of the game process program in the roulette game machine 1.

The game process program in the roulette game machine 1 is made up of a server side game process program to be executed in the server control CPU 81 and a station side game process program to be executed in the station control CPU 91. Specifically, the game process in the roulette game machine is executed by executing the server-side game process and the station-side game process.

First, the station-side game process program will be described. Upon starting execution of the game process program, the station control CPU 91 first determines whether or not the player has inserted medals. The station control CPU 91 makes the determination at step S1 in response to a detection signal from the medal sensor 97. If medals have been inserted (S1: YES), the station control CPU 91 shifts the process to step S2. On the other hand, if medals have not been inserted (S1: NO), the station control CPU 91 puts the process in stand-by.

At step S2, the station control CPU 91 executes a credit addition process. In this credit addition process (S2), the station control CPU 91 stores the credit data corresponding to an amount in accordance with the number of inserted medals in the RAM 93. At the following step S3, the station control CPU 91 transmits a medal insertion signal to the server 13. This medal insertion signal shows that medals have been inserted in the stations 4. When the medal insertion signal is transmitted to the server 13, the station control CPU 91 shifts the process to step S4.

After shifting to step S4, the station control CPU 91 executes the bet acceptance start process. In the bet acceptance start process (S4), the station control CPU 91 displays a BET screen 61 (refer to FIG. 1) onto the image display 8. Simultaneously with the display of the BET screen 61, the station control CPU 91 starts the bet period.

After the bet period starts, the players at the above-mentioned stations 4 can carry out a bet operation and a side bet operation using the touch panel 50 and the control unit 7. The procedure for the bet operation and the procedure for the side bet operation have already been described. Accordingly, further description thereof is hereby omitted.

As will be described later, once the bet period has lapsed, the server control CPU 81 transmits a bet period end signal to the station 4. This bet period end signal shows that the bet period has ended.

After receiving the bet period end signal, the station control CPU 91 executes the bet acceptance end process (S5). In the bet acceptance end process (S5), the station control CPU 91 ends acceptance of the bet operation and the side bet operation using the touch panel 50 and the like. At this time, the station control CPU 91 displays an image indicating that the bet period has ended on the image display 8. Once the bet acceptance end process (S5) has ended, the station control CPU 91 shifts the process to step S6.

After shifting to step S6, the station control CPU 91 executes a bet information transmittance process. In the bet information transmittance process (S6), the station control CPU 91 generates bet information based on the bet operation carried out by the player during the bet period, in accordance with the contents stored in the RAM 93. The station control CPU 91 transmits the bet information thus generated to the server 13. This bet information includes the bet area 72 (bet target) designated by the player, the credit amount (bet amount) which was betted as the designated bet area 72 and information with respect to the bet method (for instance, straight bet and the like). Once the bet information transmittance process (S6) has ended, the station control CPU 91 shifts the process to step S7.

At step S7, the station control CPU 91 determines whether or not a side bet operation has been carried out during the bet period. The station control CPU 91 determines whether the side bet operation has been carried out based on the contents stored in the RAM 93. If the side bet operation is carried out (S7: YES), the station control CPU 91 shifts the process to step S8. Alternatively, if the side bet operation has not been carried out (S7: NO), the station control CPU 91 shifts the process to step S9 as is.

At step S8, the station control CPU 91 carries out a side bet information transmittance process. In the side bet information transmittance process (S8), the station control CPU 91 generates side bet information based on the side bet operation carried out by the player during the bet period, in accordance with the contents stored in the RAM 93. The station control CPU 91 transmits the side bet information generated to the server 13. This side bet information includes information on the credit amount which was bet as the side bet area 73. Once the side bet information has been transmitted to server 13, the station control CPU 91 shifts the process to step S9.

While shifting from step S8 to step S9, the server control CPU 81 determines the winning number in the current 1 game. Then, the server control CPU 81 determines the payout (e.g., game result) with respect to the roulette game at each station 4 based on the above-described winning number and the bet information in each station 4. If there exists a station 4 at which the side bet was placed, the server control CPU 81 determines whether to award the first JP through the third JP, and determines the station 4 to which the JP will be awarded. The server control CPU 81 then transmits the payout information to each station 4, respectively. This payout information includes payout information concerning the roulette game in the station 4. If the JP is won, the above-described payout information includes information with respect to the JP payout that will be awarded.

At step S9, the station control CPU 91 executes a payout information receiving process. In this payout information receiving process (S9), the station control CPU 91 receives the payout information with respect to the above-described station 4 from the server 13. Once this payout information receiving process has ended, the station control CPU 91 shifts the process to step S10.

After shifting to step S10, the station control CPU 91 executes a payout process. In this payout process (S10), the station control CPU 91 adds the credit amount based on the received payout information to the credit amount which the player possesses and which is stored in the RAM 93. If the CASHOUT button 48 has been depressed, the station control CPU 91 pays out medals in accordance with the credit amount which is currently stored in the RAM 93, to the medal payout opening 9. Once the payout process (S10) is ended, the station control CPU 91 temporarily ends the station-side game process program.

The station-side game process program is repeatedly executed so long as power is supplied to the roulette game machine 1. Accordingly, once the station-side game process program is ended, the station control CPU 91 immediately executes the station-side game process program.

Next, the server-side game process program will be described. Once the execution of the game process program is started, the server control CPU 81 receives the medal detection signal (S101). As was described earlier, the medal detection signal shows that medals have been inserted in any one of the stations 4 constituting the roulette game machine 1.

Upon receiving a medal insertion signal, the server control CPU 81 starts the bet period (step S102). Specifically, the server control CPU 81 starts timing the lapse of time from the start of the bet period, which corresponds to the reception of medal insertion signal, based on the timer 84. At this time, the server control CPU 81 transmits the bet period start signal with respect to each station 4. Each station 4 starts the bet period in response to the bet period start signal. As a result, the roulette game machine 1 can synchronize the bet periods in the respective stations 4.

In the following step S103, the server control CPU 81 references the timer 84 to determine whether the bet period has reached the remaining 5 seconds. If the bet period has reached the remaining 5 seconds (S103: YES), the server control CPU 81 shifts the process to step S104. On the other hand, if the period has not yet reached the remaining 5 seconds (S103: NO), the server control CPU 81 puts the process in stand-by until the remaining bet period has reached the remaining 5 seconds.

At step S104, the server control CPU 81 executes a ball throw-in process. In this ball throw-in process (S104), the server control CPU 81 controls driving of the ball throw-in unit. Thus, the ball 27 is thrown in the roulette board of the roulette 3. The server control CPU 81 controls driving of the motor for rotation driving of the wheel 22. Thus, the wheel 22 rotates at a predetermined rotation speed in a direction opposite the ball throw-in direction. Once the ball throw-in process has ended, the server control CPU 81 shifts the process to step S105.

As was described earlier, the ball 27 thus thrown in rolls on the roulette board along the guide wall 29. Then, as the rotation speed of the ball 27 weakens, the ball tumbles down on the slanted surface of the frame 21 towards the interior of the frame. Thus, the ball 27 reaches the wheel 22 (refer to FIG. 3). Then, the ball 27 lands in any one of the number pockets 23 after passing on the number display board 25 at the outer side of the wheel 22.

At step S105, the server control CPU 81 determines whether or not the bet period has ended. The server control CPU 81 references the timer 84 and then determines whether or not the bet period has ended. If the bet period has ended (S105: YES), the server control CPU 81 shifts the process to step S106. Alternatively, if the bet period has not ended (S105: NO), the server control CPU 81 puts the process in standby until the bet period ends.

Once the bet period has ended, the server control CPU 81 transmits the bet period end signal to each station 4 (S106). After the bet period end signal is transmitted, the server control CPU 81 shifts the process to step S107.

At step S107, the server control CPU 81 executes the bet information receiving process. In this bet information receiving process (S107), the server control CPU 81 stores the bet information thus received in the bet information storage area 83A. As was described above, this bet information is transmitted from the station 4 (S6). Upon storing the bet information in the bet information storage area 83A, the server control CPU 81 associates the station 4 that transmitted the bet information with the above-described bet information. Once the bet information receiving process (S107) has ended, the server control CPU 81 shifts the process to step S108.

At step S108, the server control CPU 81 judges whether or not the side bet information has been received. As was described earlier, the side bet information is transmitted from the station 4 at which the side bet operation was carried out (S8). If the side bet information has been received (S108: YES), the server control CPU 81 stores the side bet information thus received in the side bet information storage area 83B. At this time, the server control CPU 81 associates the station 4 that transmitted the side bet information with the above-described side bet information. Then, the server control CPU 81 shifts the process to step S109. Alternatively, if the side bet information has not been received (S108: NO), the server control CPU 81 shifts the process to step S110 as is.

At step S109, the server control CPU 81 executes a JP amount accumulation process. In the JP amount accumulation process (S109), the server control CPU 81 accumulatively adds the respective JP amounts (e.g., the first JP through the third JP) of the JP accumulation storage area 87 based on the side bet information stored in the side bet information storage area 83B. Once the JP amount accumulation process is ended, the server control CPU 81 shifts the process to step S110. Concurrently with updating of each JP amount (S109), the JP amount display portion 15, the first JP display portions 74 through the third JP display portion 76 update their display contents.

Here, the JP amount accumulation process (S109) will be described in more detail. After shifting to the JP amount accumulation process (S109), the server control CPU 81 identifies the credit amount placed as the side bet (hereinafter referred to as side bet amount), based on the side bet information of the side bet information storage area 83B. Then, the server control CPU 81 accumulatively adds 3% of the side bet amount to the first JP amount of the first JP accumulation storage area 87A. Similarly, the server control CPU 81 accumulatively adds 2% of the side bet amount to the second JP amount of the second JP accumulation storage area 87B. Then, the server control CPU 81 accumulatively adds 1% of the side bet amount to the third JP amount of the third JP accumulation storage area 87C. Specifically, the roulette game machine 1 accumulatively adds a predetermined ratio of the credit on which the side bet was placed to the three kinds of JP which respectively differ from one another.

As was described earlier, the ball 27 that was thrown in in the ball throw in process (S104) rolls on the roulette board. Then, the ball 27 lands in any of the number pockets 23 that were formed in the wheel 22. After shifting to step S110, the ball 27 lands in any of the number pockets 23 that were formed in the wheel 22.

At step S110, the server control CPU 81 executes a winning number determination process. In the winning number determination process (S110), the server control CPU 81 identifies the number pocket 23 in which the ball 27 has landed under the control of the winning determination unit 86. Then, the server control CPU 81 decides the winning number in the current game, based on the number that has been associated with the identified number pocket 23. The server control CPU 81 stores the information showing the winning number thus decided in the winning number storage area 83C. Once the winning number determination process (S110) has ended, the server control CPU 81 shifts the process to step S111.

At step S111, the server control CPU 81 determines whether or not the side bet has been placed in the current game. More specifically, the server control CPU 81 carries out the determination process at step S111 based on the side bet information stored in the side bet information storage area 83B. If the side bet has been placed (S111: YES), the server control CPU 81 shifts the process to step S112. Alternatively, if the side bet has not been placed (S111: NO), the server control CPU 81 shifts the process to step S118.

After shifting to step S112, the server control CPU 81 executes a JP payout lottery process. In this JP payout lottery process (S112), the server control CPU 81 determines whether or not to award the JP payout, with respect to the first JP (MEGA JACKPOT), the second JP (MAKOR JACKPOT) and the third JP (MINI JACKPOT) individually. More specifically, the server control CPU 81 samples one random number value from a predetermined random number value range, based on the lottery program included in the game program. Then, the server control CPU 81 determines the lottery result with respect to the first JP based on the sampling random number value and the first JP lottery table (refer to FIG. 11). The server control CPU 81 stores the above-mentioned lottery result in the RAM 83. Thus, the server control CPU 81 determines whether or not to award the first JP.

The lottery result of the second JP and the lottery result of the third JP are determined in a process similar to that used in the case of the above-described first JP. The second JP lottery result is determined based on the random number value thus sampled and the second JP lottery table (refer to FIG. 12). The third JP lottery result is determined based on the random number value thus sampled and the third JP lottery table (refer to FIG. 13). In addition to the first JP lottery result, the server control CPU 81 also stores the second JP lottery result and the third JP lottery result in the RAM 83.

Accordingly, the server control CPU 81 independently determines whether or not to award the first JP, the second JP and the third JP. Once the JP payout lottery process (S112) has ended, the server control CPU 81 shifts the process to step S113.

At step S113, the server control CPU 81 determines whether a JP payout occurs based on the respective lottery results in the JP payout lottery process (S112). If it is determined to award any of the first JP through the third JP (S113: YES), the server control CPU 81 shifts the process to step S114. Alternatively, if it is determined not to award any of the first JP through the third JP (S113: NO), the server control CPU 81 shifts the process to step S118.

After shifting to step S114, the server control CPU 81 carries out a whole side bet amount calculation process. In this whole side bet amount calculation process (S114), the server control CPU 81 calculates the total side bet amount (hereinafter referred to as whole side bet amount) on which the side bet was placed in the current game, based on the side bet information stored in the side bet information storage area 83B. As was described earlier, the side bet information includes information with respect to the credit amount (side bet amount) on which the side bet was placed. Accordingly, if all side bet information in the current game is referenced, the server control CPU 81 calculates the whole side bet amount. Once the calculated whole side bet amount is stored in the RAM 83, the server control CPU 81 shifts the process to step S115.

In the case of the example shown in FIG. 14, in the whole side bet amount calculation process (S114), the server control CPU 81 calculates the whole side bet amount at "200", based on the side bet amount in station (1) through station (4).

After shifting to step S115, the server control CPU 81 executes a player contribution rate calculation process. The player contribution rate shows the degree of contribution to the accumulative addition of the first JP through third JP, in the current game. Specifically, the player contribution rate in the station 4 is calculated by the percentage covered by the side bet amount of the station 4 in the current game, with respect to the whole side bet amount in the current game. Once the player contribution rate for the station 4 at which the side bet was placed is calculated, the server control CPU 81 stores the player contribution rate of the station 4 in the RAM 83. Then, the server control CPU 81 shifts the process to step S116.

In the case of the example shown in the above-described FIG. 14, the side bet amount at the station (1) is "100". As was described earlier, the whole side bet amount in this case is "200". Accordingly, the player contribution rate at station (1) is calculated at "50%". As shown in FIG. 14, the contribution rate of the other station at which the side bet was placed is calculated using a similar calculation method.

After shifting to step S116, the server control CPU 81 executes a lottery table generating process. In this lottery table generating process (S116), the server control CPU 81 generates a lottery table based on the respective player contribution rates calculated in the player contribution rate calculation process (S115). The lottery table thus generated is used at the time of identifying the station 4 (hereinafter referred to as target station) that awards the JP payout (S117).

More specifically, the server control CPU 81 first acquires a player contribution rate at the station 4 where the side bet was placed, from the RAM 83. In the case of the example shown in FIG. 14, the server control CPU 81 acquires the player contribution rates from the station (1) through station (4) from the RAM 83.

The server control CPU 81 allocates to each station 4, a random number value range, from a predetermined random number value range (for instance, 0 through 1023), in accordance with the respective player contribution rate. In the case of the example shown in FIG. 14, the server control CPU 81 allocates a random number value range (specifically, 0 through 511) corresponding to 50% of the predetermined random number value range (0 through 1023) with respect to a station (1) at which the player contribution rate is "50%".

The lottery table is generated by associating a random number value range in accordance with the respective player contribution rate with respect to the station 4 at which the side bet was placed (refer to FIG. 15). In the case of the example shown in FIG. 14, the server control CPU 81 generates a lottery table as shown in FIG. 15. Once the lottery table thus generated is stored in the RAM 83, the server control CPU 81 shifts the process to step S117.

At step S117, the server control CPU 81 executes a target station identifying process. In this target station identifying process (S117), the server control CPU 81 identifies the station 4 to which to award the JP payout that was won in the JP payout lottery process (S112), from the stations 4 at which the side bet was placed in the current game. At the time of identifying the target station, the server control CPU 81 uses the above-described lottery program and the lottery table that was generated in the lottery table generating process (S116) (refer to FIG. 15).

Specifically, after shifting to step S117 the server control CPU 81 first samples one random number value from a predetermined random number range (for instance, 0 through 1023) by executing the lottery program. The server control CPU 81 identifies the target station based on the sampled random number value and the lottery table generated in the lottery table generating process (S116). As will be described later, the station 4 that was identified as the target station is awarded the JP payout. Once the identification results are stored in the RAM 83, the server control CPU 81 shifts the process to step S118.

At step S118, the server control CPU 81 executes the game result determination process. In the game result determination process (S118), the server control CPU 81 determines whether or not the credit that was bet in each station 4 has won, based on the bet information at each station 4 and the winning number determined in the winning number determination process (S110). Once the determination results at each station 4 are stored in the RAM 83, the server control CPU 81 shifts the process to step S119.

After shifting to step S119, the server control CPU 81 executes a payout calculation process. In the payout calculation process (S119), the server control CPU 81 calculates the contents of the payout with respect to each station 4 based on the determination result in the game result determination process (S118) and the payout magnification rate of the payout credit storage area 82A. Once the calculated payout contents are stored in the RAM 83, the server control CPU 81 shifts the process to step S120.

At step S120, the server control CPU 81 executes a payout information transmittance process. In this payout information transmittance process (S120), the server control CPU 81 generates payout information showing the contents of the payout which will be awarded to each station 4. Then, the server control CPU 81 transmits the payout information thus generated to the station 4 corresponding to the payout information. Once the payout information is transmitted to each station 4, the server control CPU 81 shifts the process to step S121.

Here, a method of generating the payout information in the payout information transmittance process (S120) will be next described in detail. First, the server control CPU 81 generates payout information for each station 4 based on the payout contents at each station 4 which have been calculated in the payout calculation process (S119).

If the target station is identified in the processes from S111 through S117, the server control CPU 81 identifies the type of the JP payout that will be awarded based on the JP payout lottery process (S112). The server control CPU 81 identifies the JP payout contents based on the contents stored in the memory area (specifically, the first JP accumulation storage area 87A through the third JP accumulation storage area 87C) corresponding to the JP payout thus identified. The server control CPU 81 generates the payout information for the target station based on the payout contents for the target station which were calculated in the payout calculation process (S119) and the JP payout contents. That is, the payout information for the target station shows payout contents which are sum of the payout contents for the roulette game and the JP payout contents.

As was described earlier, the station control CPU 91 adds the credit amount based on the payout information thus received to the credit amount that the player possesses (S10). Accordingly, upon receiving the payout information for the target station, the station control CPU 91 adds up the credit amount which is the payout for the roulette game and the credit amount which is the JP payout.

After shifting to step S121, the server control CPU 81 executes a ball retrieval process. In this ball retrieval process (S121), the server control CPU 81 retrieves the ball 27 that landed in the number pocket 23. More specifically, the server control CPU 81 controls driving of the ball retrieval unit described above. Thus, the ball 27 is retrieved from inside the number pocket 23. The ball 27 that retrieved is thrown again inside the wheel 22 of the roulette 3 for a subsequent game.

As was described above, the roulette game machine 1 according to the present embodiment accumulatively adds one portion of the side bet amount on which the player has placed a side bet to the first JP, the second JP and the third JP. In case of awarding the first JP through the third JP, the roulette game machine 1 identifies the station 4 to which the payout will be awarded from the stations 4 at which the side bet was placed. Specifically, in case the side bet was placed, the player can be awarded the first JP through the third JP. Thus, the roulette game machine 1 can award a high progressive payout without changing the payout magnification ratio and the like in the roulette game.

The roulette game machine 1 changes the winning probability with respect to the JP based on the side bet amount (S114 through S117). Accordingly, the roulette game machine 1 can reduce player's dissatisfaction led by unfairness of winning probability which does not proportionally answer to large/small number of side bet amount. Further, the roulette game machine 1 can offer new interest to the players with respect acquiring of a JP.

The present invention is not limited to the above-described embodiment and various modifications and adaptations can be made thereto without departing from the spirit of the present invention. For instance, the present invention is not meant to be applied to a roulette gaming machine only. That is, the present invention can be applied to any game, as long as this game is played amongst a plurality of players. For instance, the invention can also be applied to a card game such as Blackjack, poker or the like, or a horse racing game.

As was described in the above-described embodiment, there is no need to use three types of progressive payouts (first JP, second JP and third JP). For instance, a configuration is also possible wherein one type of progressive payout can be awarded. A configuration may also be obtained in which a plurality of types of progressive payouts can be awarded.

As was described in the embodiment, the side bet amount which was accumulatively added to obtain the JP is not required to be a portion of the side bet amount. In other words, a configuration may also be obtained wherein all side bet amounts are accumulatively added to obtain the JP.

The present invention can also be realized as a game method for executing the above-described processes. Further, the present invention can also be realized as a program and a recording medium onto which this program has been recorded that cause a computer to execute the above-mentioned gaming method.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A gaming machine having:

a plurality of terminals that accept input information from a player;

a storage device that stores information with respect to gaming values; and a processor that simultaneously progresses a first game and a second game, wherein the first game determines a game result thereof based on a stopped state of an object that is rolled at a beginning of the first game and the second game determines a game result thereof by extracting a random number, and executes processes as follows:

(a) a process of accepting a bet of a gaming value on a bet area of a betting board selected by a player for the first game during a bet period, the betting board including a plurality of bet areas each of which is associated with a stopped state of the object;

(b) a process of rolling the object and determining a game result of the first game based on a stopped state of the object with respect to a terminal at which the bet was placed for the first game;

(c) a process of determining a prize for the first game based on the game result of the first game and the gaming value bet for the first game and awarding to the player the prize for the first game;

(d) a process of accepting a side bet of gaming value placed by a player for the second game during the bet period;

(e) a process of accumulatively adding a predetermined ratio of the gaming value on which the side bet was placed for the second game and then storing accumulative gaming value amount in the storage device;

(f) a process of calculating a player contribution rate for the accumulative gaming value amount;

(g) a process of generating a lottery table based on the player contribution rate, if the side bet was placed for the second game during the bet period;

(h) a process of carrying out a lottery with using the generated lottery table for the second game with respect to a terminal at which the side bet was placed for the second game by extracting a random number;

(i) a process of awarding a prize for the second game based on the lottery result for the second game; and (j) a process of adding gaming value awarded to the player as the prize for the first game to gaming value awarded to the player as the prize for the second game and storing the added amount of the gaming values to the storage device.

2. The gaming machine according to claim 1, wherein, a probability of a win provided by the lottery table is in proportion to the player contribution rate.

3. The gaming machine according to claim 1, wherein the storage device has a plurality of storage areas that store information with respect to a gaming value;

wherein, at the process (e), the processor accumulatively adds predetermined ratio of the gaming value placed for the second game to each of the plurality of storage areas.

4. The gaming machine according to claim 2, wherein the storage device has a plurality of storage areas that store information with respect to a gaming value;

wherein, at the process (e), the processor accumulatively adds predetermined ratio of the gaming value placed for the second game to each of the plurality of storage areas.

5. A gaming machine having:

a plurality of terminals that accept input information from a player;

a wheel onto which a plurality of number pockets are arranged, each of these number pockets being allocated an identification number;

a ball that rolls on the wheel and lands in any of the plurality of number pockets;

a winning number detection device that detects the identification number that was allocated to the number pocket in which the ball has landed, as a winning number;

a storage device that has a plurality of storage areas in which information with respect to a gaming value is stored; and a processor that simultaneously progresses a first game and a second game, wherein the first game corresponds to a roulette of which game result is determined based on a number pocket in which the ball rolled at the beginning of the first game has landed and the second game determines a game result thereof by extracting a random number, and executes processes as follows:

(a) a process of accepting a bet of a gaming value on a bet area of a betting board selected by a player for the first game during a bet period, the bet targeting the identification number associated with the bet area selected by the player the betting board including a plurality of bet areas each of which is associated with an identification number;

(b) a process of allowing the ball to start rolling on the wheel;

(c) a process of determining a game result of the first game for the player that placed the bet for the first game, based on the winning number detected by the winning number detection device and the identification number associated with the bet area selected by the player;

(d) a process of determining a prize for the first game based on the game result of the first game and the gaming value that was bet for the first game and awarding to the player a first prize for the first game;

(e) a process of accepting a side bet of a gaming value that was placed by a player for the second game during the bet period;

(f) a process of accumulatively adding a predetermined ratio of the gaming value on which the side bet was placed for the second game in the plurality of storage areas, respectively;

(g) a process of calculating a player contribution rate for an accumulative gaming value amount which is sum of the gaming value accumulatively added in step (f);

(h) a process of determining, if the side bet for the second game has been placed during the bet period, whether or not to award a second prize for the second game;

(i) a process of generating a lottery table based on the player contribution rate, if it is determined to award the second prize for the second game;

(j) a process of carrying out a lottery with using the generated lottery table to determine a terminal at which the second prize for the second game is awarded, from terminals at which the side bet was placed for the second game by extracting a random number;

(k) a process of awarding the second prize for the second game corresponding to the lottery result, with respect to a terminal corresponding to the lottery result; and (l) a process of adding the first prize awarded to the player to the second prize awarded to the player and storing the added amount of the first prize and the second prize to the storage device.

6. The gaming machine according to claim 5, wherein, a probability of a win provided by the lottery table is in proportion to the player contribution rate.

* * * * *